US009564687B2

(12) United States Patent
Maruyama

(10) Patent No.: US 9,564,687 B2
(45) Date of Patent: Feb. 7, 2017

(54) DIRECTIVE ANTENNA APPARATUS MOUNTED ON A BOARD

(71) Applicant: Samsung Electronics Co., Ltd., Gyeonggi-do (KR)

(72) Inventor: Akihiro Maruyama, Kanagawa (JP)

(73) Assignee: SAMSUNG ELECTRONICS CO., LTD, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/649,521

(22) PCT Filed: Oct. 29, 2013

(86) PCT No.: PCT/KR2013/009662
§ 371 (c)(1),
(2) Date: Jun. 3, 2015

(87) PCT Pub. No.: WO2014/088210
PCT Pub. Date: Jun. 12, 2014

(65) Prior Publication Data

US 2015/0318616 A1 Nov. 5, 2015

(30) Foreign Application Priority Data

Dec. 3, 2012 (JP) ..... 2012-264537

(51) Int. Cl.

| | |
|---|---|
| ***H01Q 9/04*** | (2006.01) |
| ***H01Q 19/00*** | (2006.01) |
| ***H01Q 19/10*** | (2006.01) |
| ***H01Q 3/24*** | (2006.01) |
| ***H01Q 19/28*** | (2006.01) |

(Continued)

(52) U.S. Cl.
CPC ..... *H01Q 9/0407* (2013.01); *H01Q 3/24* (2013.01); *H01Q 19/005* (2013.01); *H01Q 19/10* (2013.01); *H01Q 19/28* (2013.01); *H01Q 19/30* (2013.01); *H01Q 21/28* (2013.01)

(58) Field of Classification Search
CPC ..... H01Q 9/0407; H01Q 19/005; H01Q 21/28
USPC ..... 343/702, 749, 850, 833
See application file for complete search history.

(56) References Cited

U.S. PATENT DOCUMENTS 5,365,246 A * 11/1994 Rasinger ..... H01Q 1/243 343/702
5,682,143 A 10/1997 Brady et al.
(Continued)

FOREIGN PATENT DOCUMENTS

JP 2001-110837 4/2001
JP 2008-509597 3/2008
(Continued)

OTHER PUBLICATIONS

International Search Report dated Feb. 14, 2014 in connection with International Patent Application No. PCT/KR2013/009662, 3 pages.

*Primary Examiner* — Peguy Jean Pierre

(57) ABSTRACT

There is provided an antenna apparatus including a first wire connecting a first metal part to a fourth metal part, a second wire connecting a second metal part to a feeder, and a third wire connecting a third metal part to a fourth metal part, wherein the first, second, and third wires are arranged in parallel to one edge of a semiconductor chip, and the second wire is disposed between the first wire and the third wire.

20 Claims, 7 Drawing Sheets

(51) Int. Cl.
*H01Q 19/30* (2006.01)
*H01Q 21/28* (2006.01)

(56) References Cited

U.S. PATENT DOCUMENTS

| | | | | |
|---|---|---|---|---|
| 6,049,310 | A * | 4/2000 | Sadahiro | H01Q 3/44 343/702 |
| 6,750,825 | B1 * | 6/2004 | Delaveaud | H01Q 1/48 343/749 |
| 7,518,221 | B2 | 4/2009 | Gaucher et al. | |
| 2006/0028378 | A1 | 2/2006 | Gaucher et al. | |
| 2006/0176233 | A1 * | 8/2006 | Tang | H01Q 9/40 343/850 |
| 2010/0148892 | A1 * | 6/2010 | Tsutsumi | H01P 5/107 333/254 |
| 2015/0155797 | A1 * | 6/2015 | Okayama | H01L 23/49541 363/131 |

FOREIGN PATENT DOCUMENTS

| | | |
|---|---|---|
| KR | 10-2009-0092958 | 9/2009 |
| KR | 10-2011-0021418 | 3/2011 |

* cited by examiner

DIRECTIVE ANTENNA APPARATUS MOUNTED ON A BOARD

CROSS-REFERENCE TO RELATED APPLICATION(S)

The present application claims priority under 35 U.S.C. §365 to International Patent Application No. PCT/KR2013/009662 filed Oct. 29, 2013, entitled "ANTENNA APPARATUS", and, through International Patent Application No. PCT/KR2013/009662, to Japanese Application No. 2012-264537 filed Dec. 3, 2012, each of which are incorporated herein by reference into the present disclosure as if fully set forth herein.

TECHNICAL FIELD

The present invention relates generally to an antenna apparatus, and more particularly, to an antenna apparatus mounted on a board and having directivity.

BACKGROUND ART

For communication between devices in a wireless communication network, an antenna apparatus for transmitting desired waves toward other devices and receiving waves transmitted from other devices is needed. A technique of connecting one or more wires to a chip mounted on a board, and using the wires as radiating elements is disclosed in Japanese Laid-open Patent Application No. 2008-509597.

An antenna apparatus disclosed in the Japanese Laid-open Patent Application No. 2008-509597 tends to have directivity in a direction perpendicular to a board, wherein metal on a chip or on the board acts as a reflector. For wireless communication between a plurality of chips mounted on a board, an antenna apparatus having directivity in a direction at least horizontal to a board is needed.

The above information is presented as background information only to assist with an understanding of the present disclosure. No determination has been made, and no assertion is made, as to whether any of the above might be applicable as prior art with regard to the present invention.

DISCLOSURE OF INVENTION

Summary

An antenna apparatus is provided. The antenna apparatus includes a dielectric substrate. The antenna apparatus also includes a semiconductor chip mounted on the dielectric substrate. The antenna apparatus further includes a first metal part, a second metal part, and a third metal part each formed on the dielectric substrate. The antenna apparatus includes a feeder formed on the semiconductor chip. The antenna apparatus also includes a fourth metal part formed on the semiconductor chip. The antenna apparatus further includes an antenna element configured to perform wireless communication in a frequency band of milliwaves. The antenna element includes a first wire connecting the first metal part to the fourth metal part, a second wire connecting the second metal part to the feeder, and a third wire connecting the third metal part to the fourth metal part. The first wire, the second wire, and the third wire are each arranged in parallel to an edge of the semiconductor chip. The second wire is positioned between the first wire and the third wire.

Technical Problem

Aspects of the present invention are to address at least the above-mentioned problems and/or disadvantages and to provide at least the advantages described below. Accordingly, an aspect of the present invention is to provide an antenna apparatus having directivity in a direction horizontal to a printed board by connecting a plurality of wires between the printed board and a chip, and using the wires as an antenna.

Solution to Problem

In accordance with an aspect of the present invention, there is provided an antenna apparatus including: a dielectric substrate; a semiconductor chip mounted on the dielectric substrate; first, second, and third metal parts formed on the dielectric substrate; a feeder formed on the dielectric chip; a fourth metal part formed on the semiconductor chip; and an antenna element configured to perform wireless communication in a frequency band of milliwaves, wherein the antenna element comprises: a first wire connecting the first metal part to the fourth metal part; a second wire connecting the second metal part to the feeder; and a third wire connecting the third metal part to the fourth metal part, wherein the first, second, and third wires are arranged in parallel to one edge of the semiconductor chip, and the second wire is disposed between the first wire and the third wire.

The longer sides of the first and third metal parts may be aligned in a direction in which the first and third wires extend, and the longer sides of the first and third metal parts may be formed to be opposite to the semiconductor chip at ends at which the first and third wires are respectively connected. A valid length of the first wire may be a sum of a length of the first wire and a length of the longer side of the first metal part, and a valid length of the third wire may be a sum of a length of the third wire and a length of the longer side of the third metal part.

The antenna apparatus may further include first and second switches respectively provided on the first and third metal parts, and configured to change lengths of the longer sides of the first and third metal parts.

A wire having a longest valid length among the first, second, and third wires may be used as a first element, a wire having a second longest valid length among the first, second, and third wires may be used as a second element, and a wire having a shortest valid length among the first, second, and third wires may be used as a third element.

The first element may act as a reflector. The second element may act as an antenna element. The third element may act as a director. The antenna apparatus may further include an additional antenna element, wherein the antenna element and the additional antenna element have opposite directivities.

Other aspects, advantages, and salient features of the invention will become apparent to those skilled in the art from the following detailed description, which, taken in conjunction with the annexed drawings, discloses exemplary embodiments of the invention.

Advantageous Effects of Invention

According to the present invention, an antenna apparatus capable of adjusting directivity by adjusting the length of each element of the antenna apparatus is provided.

Also, according to the present invention, the antenna apparatus capable of dynamically changing directivity by providing antennas each composed of three elements respectively in opposite edges of an IC chip and selecting an antenna to be used from among the antennas through switching is provided.

Also, according to the present invention, the antenna apparatus may have directivity in a direction horizontal to a printed board by connecting a plurality of wires between the printed board and a chip, and using the wires as an antenna.

BRIEF DESCRIPTION OF DRAWINGS

The above and other aspects, features and advantages of certain exemplary embodiments of the present invention will be more apparent from the following description taken in conjunction with the accompanying drawings, in which.

Throughout the drawings, like reference numerals will be understood to refer to like parts, components, and structures.

MODE FOR THE INVENTION

The following description with reference to the accompanying drawings is provided to assist in a comprehensive understanding of exemplary embodiments of the invention as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but are merely used by the inventor to enable a clear and consistent understanding of the invention. Accordingly, it should be apparent to those skilled in the art that the following description of exemplary embodiments of the present invention is provided for illustration purposes only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the singular forms "a", "an" and "the" are intended to include the plural forms as well, unless the context clearly indicates otherwise.

Hereinafter, embodiments of the present invention will be described in detail with reference to the accompanying drawings. Throughout the following description and drawings, identical reference numbers refer to components having the substantially same function throughout the several views, and repeated descriptions for the components will be omitted.

First Embodiment

Figure 1:
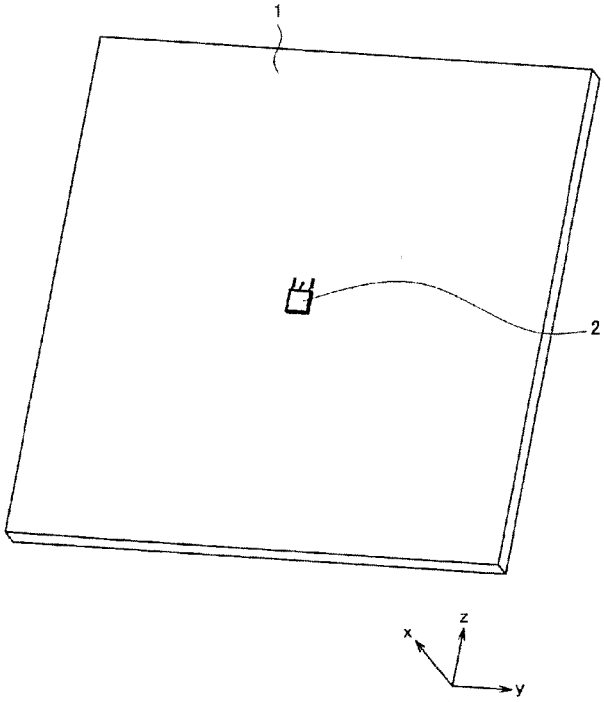
FIG. 1 illustrates an external appearance of an antenna apparatus according to a first embodiment of the present invention.

First, a configuration example of an antenna apparatus according to a first embodiment of the present invention will be described with reference to the accompanying drawings. FIG. 1 illustrates an external appearance of the antenna apparatus according to the first embodiment of the present invention. In FIG. 1, a printed board 1, and an Integrated Circuit (IC) chip 2 mounted on the printed board 1 are shown.

The printed board 1 is a board for fixing and wiring electronic elements. The printed board 1 may be made of polytetrafluoroethylene or Flame Retardant Type 4 (FR4), however, the printed board 1 may be made of any other material. The IC chip 2 is an integrated circuit configured to perform wireless communication with another device (e.g., another IC chip mounted on the printed board 1) through an antenna which will be described later. The IC chip 2 may be made of Si, SiGe, gallium, or arsenic, however, the IC chip 2 may be made of any other material.

X-, Y-, and Z-axes are defined as illustrated in FIG. 1. That is, the X-axis extends in a direction orthogonal to the surface of the printed board 1, the Y-axis extends in a direction horizontal to the surface of the printed board 1 and perpendicular to one edge of the IC chip 2, and the Z-axis extends in a direction horizontal to the surface of the printed board 1 and orthogonal to the X- and Y-axes.

The antenna apparatus connected to the IC chip 2 is configured to perform wireless communication, specifically, in a frequency band of milliwaves. By connecting the antenna apparatus to the IC chip 2 and adjusting directivity of the antenna apparatus, wireless communication between the IC chip 2 and another IC chip that is mounted on the printed circuit 1 is possible.

Hereinafter, a configuration example of the antenna apparatus connected to the IC chip 2 will be described in more detail with reference to FIG. 2.

Figure 2:
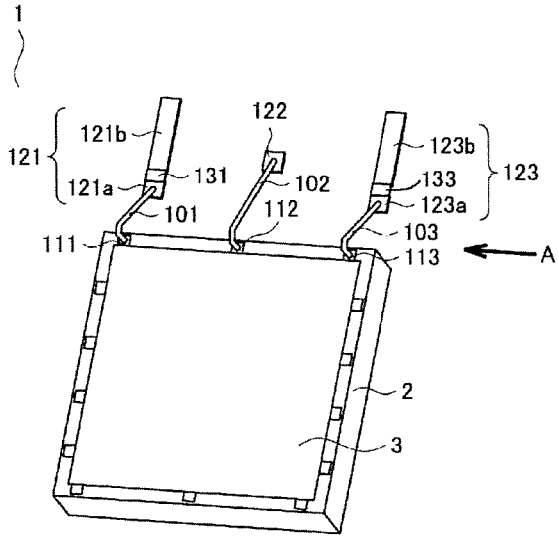
FIG. 2 illustrates a configuration example of the antenna apparatus according to the first embodiment of the present invention.

FIG. 2 illustrates a configuration example of the antenna apparatus according to the first embodiment of the present invention. FIG. 2 is an enlarged view of the IC chip 2 and the antenna apparatus illustrated in FIG. 1.

As illustrated in FIG. 2, the antenna apparatus according to the first embodiment of the present invention includes metal pads 111, 112, and 113 provided on the IC chip 2, metal parts 121, 122, and 123 formed on the surface of the printed board 1, and bond wires 101, 102, and 103 connecting the metal pads 111, 112, and 113 to the metal parts 121, 122, and 123. On the upper surface of the IC chip 2, a metal part 3 is provided. The metal part 3 may be made of aluminum, copper, or gold, however, the metal part 3 may be made of any other material.

As illustrated in FIG. 2, one ends of the bond wires 101, 102, and 103 are respectively connected to the metal pads 111, 112, and 113 provided on one edge of the IC chip 2, and the other ends of the bond wires 101, 102, and 103 are respectively connected to the metal parts 121, 122, and 123 such that the bond wires 101, 102, and 103 are arranged in parallel to each other.

The bond wire 102 is connected to the metal pad 112, and wired to a feeder (e.g., a singlet) provided on the IC chip 2. The bond wires 101 and 103 are respectively connected to the metal pads 111 and 113, and wired to the metal part 3 provided on the surface of the IC chip 2 such that no power is fed to the bond wires 101 and 103. Since the bond wire 102 is wired to the feeder provided on the IC chip 2, the antenna apparatus according to the first embodiment of the present invention may emit waves according to predetermined directivity, or receive waves emitted from another antenna apparatus.

The metal part 121 connected to one end of the bond wire 101 includes a first metal area 121*a* and a second metal area 121*b*. A switch 131 is provided between the first metal area 121*a* and the second metal area 121*b*. Likewise, the metal part 123 connected to one end of the bond wire 103 includes a first metal area 123*a* and a second metal area 123*b*. A switch 133 is provided between the first metal area 123*a* and the second metal area 123*b*.

Figure 3:
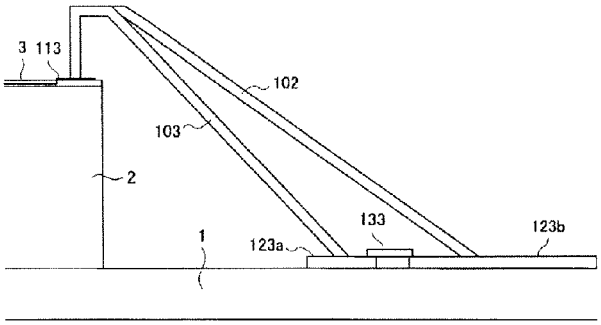
FIG. 3 illustrates the antenna apparatus according to the first embodiment of the present invention, seen in a direction A of FIG. 2.

FIG. 3 illustrates the antenna apparatus according to the first embodiment of the present invention, seen in a direction A of FIG. 2. In FIG. 3, the bond wires 102 and 103 are connected to the IC chip 2 and the metal parts 122 and 123*a* provided on the printed board 1, however, the bond wires 101, 102 and 103 may be connected to the IC chip 2 and the printed board 1 in another form.

The antenna apparatus according to the first embodiment of the present invention includes three elements including the bond wires 101, 102 and 103, as illustrated in FIG. 2. In the antenna apparatus, by adjusting a valid length of the bond wire included in each element, the length of the element is changed so that directivity is adjusted. If the antenna apparatus adopts a structure of a Yagi-Uda Antenna, the individual elements are shortened in order from the left side or from the right side.

In the current embodiment, the valid length of each of the bond wires 101 and 103 is obtained by adding the length of the bond wire 101 or 103 to the length of the longer side of the metal part 121*b* or 123*b* connected to the bond wire 101 or 103. Whether to add the lengths of the longer sides of the metal parts 121*b* and 123*b* respectively to the lengths of the bond wires 101 and 103 respectively connected to the metal part 121*b* and 123*b* is determined according to on/off operations of the switches 131 and 133.

If the switch 131 is turned on, and the switch 133 is turned off, the element including the bond wire 101 and the metal part 121 acts as a reflector, the element including the bond wire 102 acts as an antenna element (a radiating device), and the element including the bond wire 103 and the metal part 123 acts as a director.

In contrast, if the switch 131 is tuned off, and the switch 133 is turned on, the element including the bond wire 101 and the metal part 121 acts as a director, the element including the bond wire 102 acts as an antenna element (a radiating device), and the element including the bond wire 103 and the metal part 123 acts as a reflector.

The switches 131 and 133 may be turned on/off according to a command from the IC chip 2 or from another IC chip 2.

Figure 4:
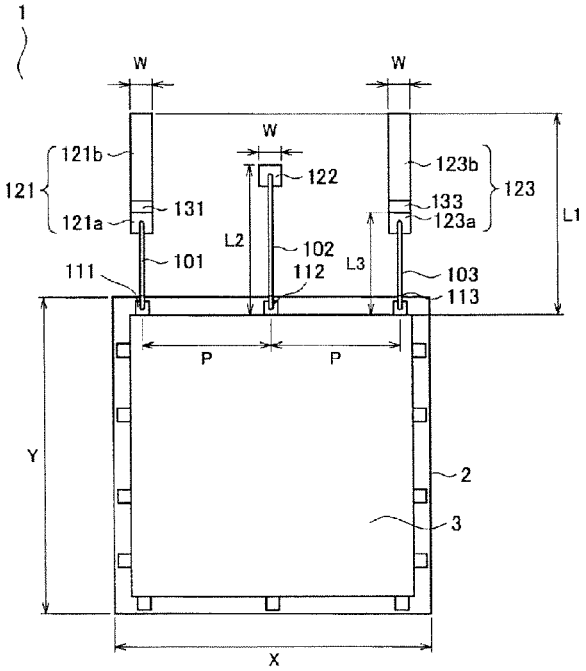
FIGS. 4 and 5 are views for describing parameters that define dimensions of elements constructing the antenna apparatus.
Figure 5:
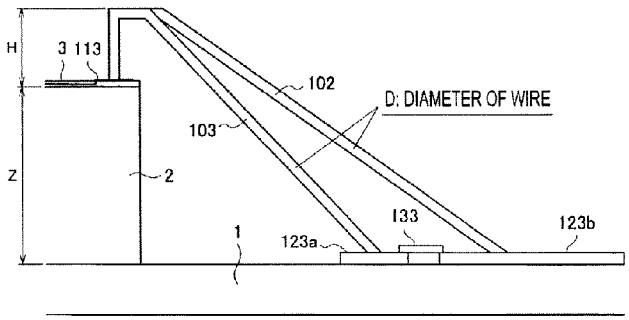

An example of dimension parameters of the individual elements constructing the antenna apparatus according to the first embodiment of the present invention, as illustrated in FIGS. 2 and 3, will be described below. For example, if the antenna apparatus has been designed to obtain a resonance frequency at 80 GHz, dimension parameters as shown in Table 1 can be adopted. FIGS. 4 and 5 are views for describing the dimension parameters as shown in Table 1, which define the dimensions of the individual elements constructing the antenna apparatus.

TABLE 1

| | |
|---|---|
| I.C. size_X | 3 mm |
| I.C. size_Y | 3 mm |
| I.C. size_Z | 270 μm |
| L1 | 920 μm |
| L2 | 660 μm |
| L3 | 400 μm |
| P: Interval Between Wires | 600 μm |
| D: Diameter of Wire | 20 μm |
| H: Height of Wire | 130 μm |
| W: Band Width | 100 μm |

In Table 1, L1 is obtained by adding the length of the bond wire 101 or 103 to the length of the longer side of the metal part 121*b* or 123*b*, L2 is the length of the bond wire 102, and L3 is the length of the bond wire 101 or 103.

Figure 6:
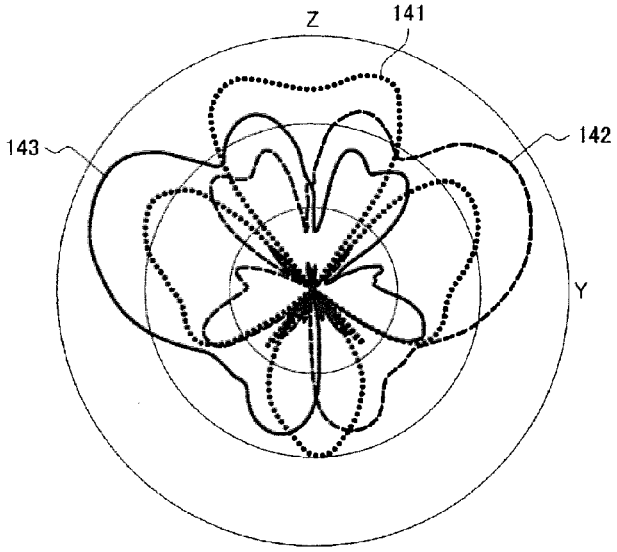
FIG. 6 illustrates an example of radiation directivity of the antenna apparatus according to the first embodiment of the present invention.

L2 may be set to a length corresponding to ¼ of the wavelength of a used frequency. Hereinafter, radiation directivity of the antenna apparatus having the dimension parameters as shown in Table 1 will be described with reference to FIG. 6. FIG. 6 illustrates an example of radiation directivity of the antenna apparatus according to the first embodiment of the present invention as illustrated in FIG. 2. In FIG. 6, 0 degree represents a positive direction on Z-axis, and 90 degrees represent a positive direction on Y-axis. The radiation directivity was calculated using 3Dimensional (3D) electromagnetic simulation.

In FIG. 6, a line denoted by a reference numeral 141 shows radiation directivity when both the switches 131 and 133 are turned on, a line denoted by a reference numeral 142 shows radiation directivity when the switch 131 is turned on and the switch 133 is turned off, and a line denoted by a reference numeral 143 shows radiation directivity when the switch 131 is turned off and the switch 133 is tuned on.

As illustrated in FIG. 6, when both the switches 131 and 133 are turned on, the antenna apparatus has radiation directivity in the positive direction on Z-axis. When the switch 131 is tuned on, and the switch 133 is turned off, the antenna apparatus has radiation directivity in the positive direction on Y-axis, and when the switch 131 is turned off, and the switch 133 is turned on, the antenna apparatus has radiation directivity in the negative direction on Y-axis.

In other words, the antenna apparatus has radiation directivities in three directions according to on/off operations of the switches 131 and 133, which is illustrated in FIG. 6. Specifically, since the antenna apparatus has more excellent radiation directivity in the positive or negative direction on Y-axis than in the positive or negative direction on Z-axis, when another antenna apparatus is appropriately mounted on the printed board 1, the antenna apparatus can perform wireless communication in a frequency band of milliwaves with the other antenna apparatus mounted on the printed board 1.

Also, by arranging another party for communication in the Y-axis direction, a more effective communication environment may be built. Since in the frequency band of milliwaves, propagation loss is high, a semiconductor substrate has low efficiency, and a Radio Frequency (RF) circuit has high internal loss, a high-gain antenna will be effectively used for stable communication. Therefore, by adopting the antenna apparatus according to the first embodiment of the present invention, high-efficient wireless communication in the frequency band of milliwaves is possible.

The antenna apparatus according to the first embodiment of the present invention has a structure in which three elements are provided in one edge of the IC chip 2, as illustrated in FIG. 2, however, the antenna apparatus is not limited to the structure illustrated in FIG. 2.

Figure 7:
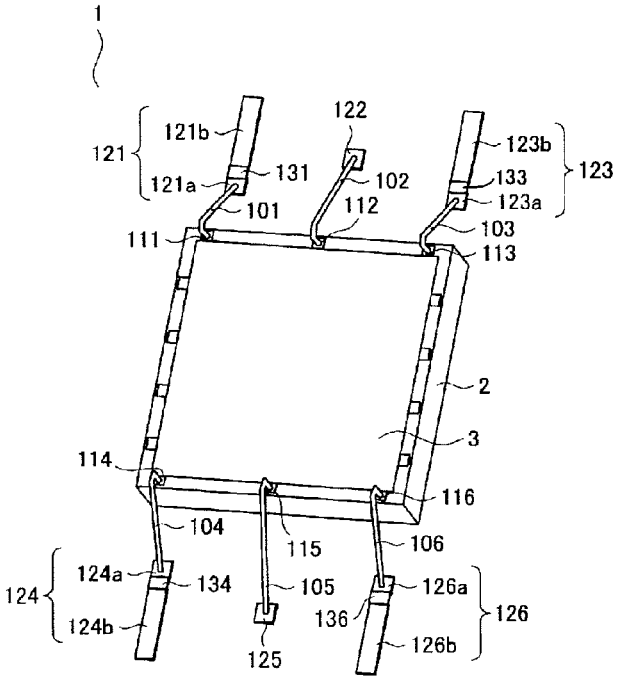
FIG. 7 illustrates a modified example of the antenna apparatus according to the first embodiment of the present invention.

FIG. 7 illustrates a modified example of the antenna apparatus according to the first embodiment of the present invention. In FIG. 7, a structure in which three elements are provided in each of opposite edges of the IC chip 2 is shown.

As illustrated in FIG. 7, the modified example of the antenna apparatus according to the first embodiment of the present invention may include, in addition to the structure illustrated in FIG. 2, metal pads 114, 115, and 116 provided on the IC chip 2, metal parts 124, 125, and 126 formed on the surface of the printed board 1, and bond wires 104, 105, and 106 connecting the metal pads 114, 115, and 116 to the metal parts 124, 125, and 126.

The metal part 124 connected to one end of the bond wire 104 includes a first metal area 124*a* and a second metal area 124*b*. A switch 134 is provided between the first and second metal parts 124*a* and 124*b*. Likewise, the metal part 126 connected to one end of the bond wire 106 includes a first metal area 126*a* and a second metal area 126*b*. Also, a switch 136 is provided between the first and second metal areas 126*a* and 126*b*.

Figure 8:
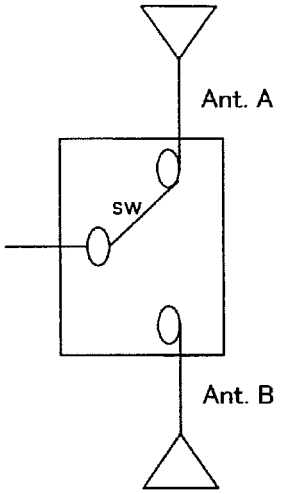
FIG. 8 illustrates a switch for switching between antennas A and B.

If an antenna illustrated in the upper part of FIG. 7 is referred to as an antenna A, and an antenna illustrated in the lower part of FIG. 7 is referred to as an antenna B, whether to use which one of the antennas A and B may be selected by a switching operation of a switch installed in the IC chip 2. FIG. 8 illustrates a switch sw for switching between the antennas A and B. By a switching operation of the switch sw, one of the antennas A and B is selected and used.

By using the structure in which three elements are provided in each of the opposite edges of the IC chip 2, as illustrated in FIG. 7, the modified example of the antenna apparatus according to the first embodiment of the present invention may dynamically change radiation directivity according to a switching operation of the switch sw. For example, by appropriately setting on/off of the switches 131, 133, 134, and 136, and making the antennas A and B have opposite radiation directivities, the modified example of the antenna apparatus according to the first embodiment of the present invention may dynamically change radiation directivity to the diametrical opposite through a switching operation of the switch sw.

Figure 9:
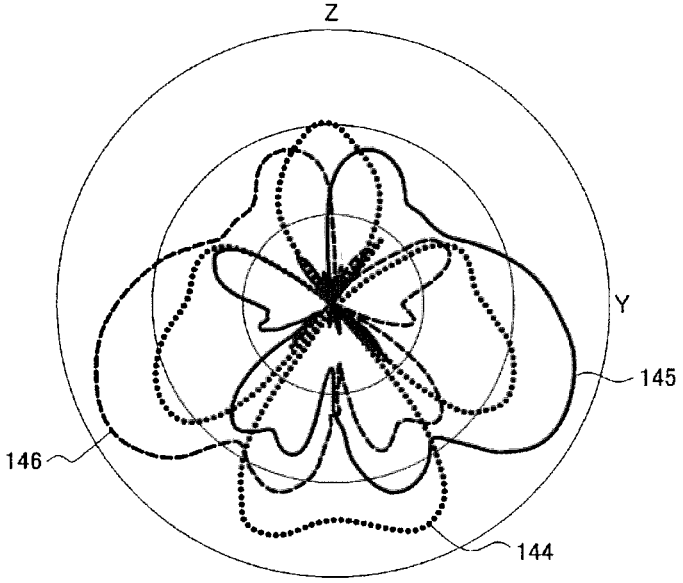
FIG. 9 illustrates an example of radiation directivity of the antenna B in the modified example of the antenna apparatus according to the first embodiment of the present invention.

FIG. 9 illustrates an example of radiation directivity of the antenna B in the modified example of the antenna apparatus according to the first embodiment of the present invention. In FIG. 9, like FIG. 6, 0 degree represents a positive direction on Z-axis, and 90 degrees represent a positive direction on Y-axis.

In FIG. 9, a line denoted by a reference numeral 144 shows radiation directivity when both the switches 134 and 136 are turned on, a line denoted by a reference numeral 145 shows radiation directivity when the switch 134 is turned on, and the switch 136 is turned off, and a line denoted by a reference numeral 146 shows radiation directivity when the switch 134 is turned off, and the switch 136 is tuned on.

As illustrated in FIG. 9, when both the switches 134 and 136 are turned on, the modified example of the antenna apparatus according to the first embodiment of the present invention has radiation directivity in the negative direction on Z-axis. When the switch 134 is tuned on, and the switch 136 is turned off, the modified example of the antenna apparatus according to the first embodiment of the present invention has radiation directivity in the positive direction on Y-axis, and when the switch 134 is turned off, and the switch 136 is turned on, the modified example of the antenna apparatus according to the first embodiment of the present invention has radiation directivity in the negative direction on Y-axis.

As described above, according to the first embodiment of the present invention, an antenna apparatus in which an antenna including three elements is connected to at least one edge of the IC chip 2 is provided. The antenna apparatus according to the first embodiment of the present invention has great radiation directivity in a specific direction by configuring a Yagi-Uda antenna with bond wires connecting the IC chip 2 to the printed board 1. Due to the high operating frequency of milliwaves, a wavelength is shortened, and accordingly, a compact antenna can be designed. Like the antenna apparatus according to the first embodiment of the present invention, installing an antenna in an IC chip is possible.

Second Embodiment

Now, a second embodiment of the present invention will be described. The second embodiment of the present invention relates to an antenna apparatus including elements composed of only bond wires.

Figure 10:
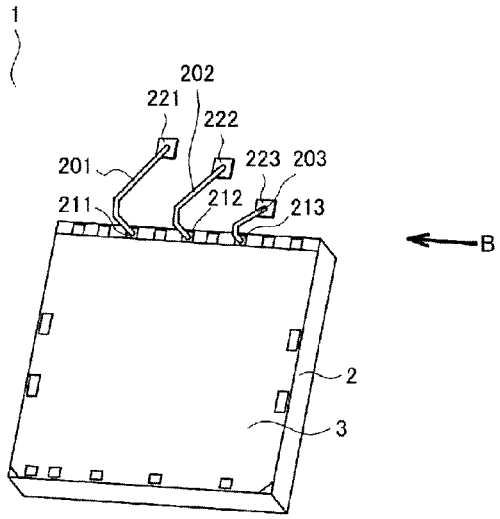
FIG. 10 illustrates a configuration example of an antenna apparatus according to a second embodiment of the present invention.

FIG. 10 illustrates a configuration example of an antenna apparatus according to a second embodiment of the present invention.

As illustrated in FIG. 10, the antenna apparatus according to the second embodiment of the present invention includes metal pads 211, 212, and 213 provided on an IC chip 2, metal parts 221, 222, and 223 provided on the surface of a printed board 1, and bond wires 201, 202, and 203 connecting the metal pads 211, 212, and 213 to the metal parts 221, 222, and 223. A metal part 3 is provided on the upper surface of the IC chip 2. The metal part 3 may be made of, for example, aluminum, copper, or gold, however, the metal part 3 may be made of any other material.

As illustrated in FIG. 10, one ends of the bond wires 201, 202, and 203 are respectively connected to the metal pads 211, 212, and 213 provided on one edge of the IC chip 2, and the other ends of the bond wires 201, 202, and 203 are respectively connected to the metal parts 221, 222, and 223 such that the bond wires 201, 202, and 203 are arranged in parallel to each other.

The bond wire 202 is connected to the metal pad 112, and wired to a feeder (a singlet) provided on the IC chip 2. The bond wires 201 and 203 are respectively connected to the metal pads 211 and 213, and wired to the metal part 3 provided on the surface of the IC chip 2.

Figure 11:
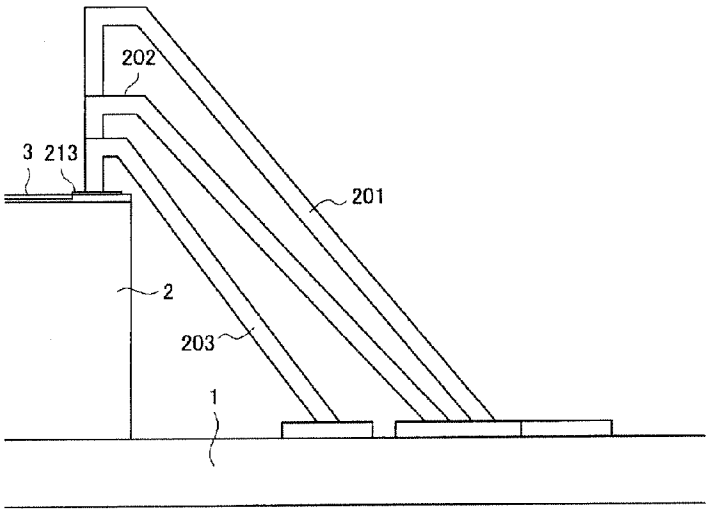
FIG. 11 illustrates the antenna apparatus according to the second embodiment of the present invention, seen in a direction B of FIG. 10.

FIG. 11 illustrates the antenna apparatus according to the second embodiment of the present invention, seen in a direction B of FIG. 10. In FIG. 11, the bond wires 201, 202 and 203 are respectively connected to the IC chip 2 and the metal parts 221, 222, and 223 provided on the printed board 1, however, the bond wires 201, 202 and 203 may be connected to the IC chip 2 and the printed board 1 in another form.

The antenna apparatus according to the second embodiment of the present invention includes antenna elements composed of only the bond wires 201, 202, and 203. For example, by shortening the lengths of the bond wires 201, 202, and 203 in order of the bond wires 201, 202, and 203, a Yagi-Uda Antenna may be configured in which the bond wire 201 acts as a reflector, the bond wire 202 acts as an antenna element (a radiating device), and the bond wire 203 acts as a director.

Figure 12:
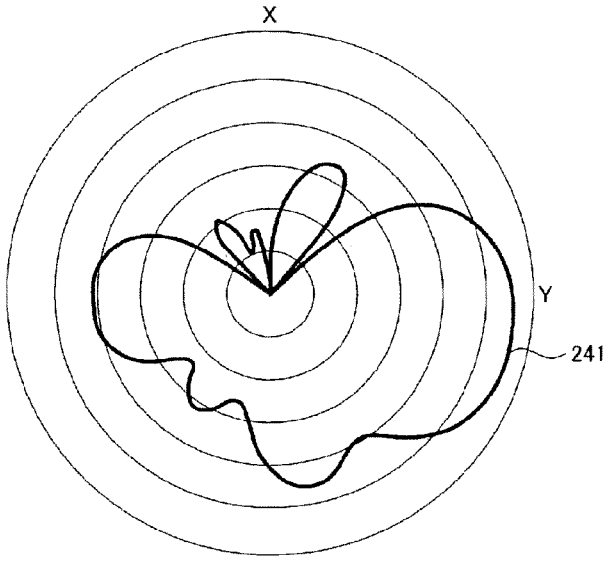
FIG. 12 illustrates an example of radiation directivity of the antenna apparatus according to the second embodiment of the present invention.

FIG. 12 illustrates an example of radiation directivity of the antenna apparatus according to the second embodiment of the present invention. In FIG. 12, 0 degree represents a positive direction on X-axis, and 90 degrees represent a positive direction on Y-axis. The radiation directivity was calculated using 3D electromagnetic simulation.

As illustrated in FIG. 12, the antenna apparatus according to the second embodiment of the present invention as illustrated in FIG. 10 has radiation directivity in the positive direction on Y-axis. The antenna apparatus according to the second embodiment of the present invention, having radiation directivity in the positive direction on Y-axis, can perform wireless communication in a frequency band of milliwaves with another antenna apparatus mounted on the printed board 1 by appropriately arranging the other antenna apparatus on the printed board 1. Also, by arranging another party for communication in the Y-axis direction, a more effective communication environment may be built, like the first embodiment.

The antenna apparatus according to the second embodiment of the present invention has, as illustrated in FIG. 10, a structure in which three elements are provided in one edge of the IC chip 2, however, the antenna apparatus according to the second embodiment of the present invention is not limited to this structure.

Figure 13:
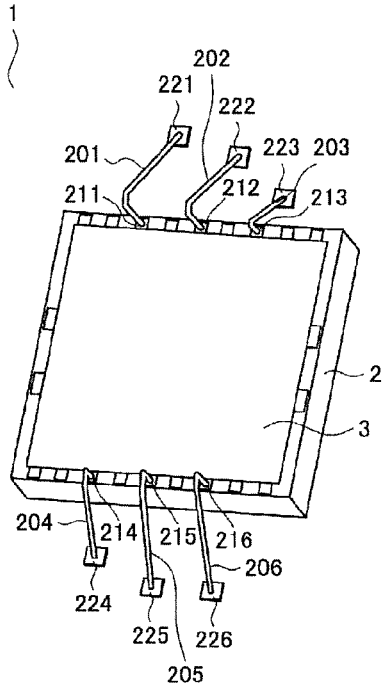
FIG. 13 illustrates a modified example of the antenna apparatus according to the second embodiment of the present invention.

FIG. 13 illustrates a modified example of the antenna apparatus according to the second embodiment of the present invention. FIG. 13 shows a structure in which three elements are provided in each of opposite edges of the IC chip 2.

As illustrated in FIG. 13, the modified example of the antenna apparatus according to the second embodiment of the present invention includes, in addition to the structure illustrated in FIG. 10, metal pads 214, 215, and 216 provided on the IC chip 2, metal parts 224, 225, and 226 formed on the surface of the printed board 1, and bond wires 204, 205, and 206 connecting the metal pads 214, 215, and 216 to the metal parts 224, 225, and 226.

As illustrated in FIG. 13, one ends of the bond wires 204, 205, and 206 are respectively connected to the metal pads 214, 215, and 216 provided on one edge of the IC chip 2, and the other ends of the bond wires 204, 205, and 206 are respectively connected to the metal parts 224, 225, and 226 such that the bond wires 204, 205, and 206 are arranged in parallel to each other.

The bond wire 205 is connected to the metal pad 215, and wired to a feeder (singlet) provided on the IC chip 2. The bond wires 204 and 206 are respectively connected to the metal pads 214 and 216, and wired to the metal part 3 provided on the surface of the IC chip 2.

The modified example of the second embodiment of the present invention relates to an antenna apparatus including antenna elements composed of only bond wires 204, 205, and 206. For example, by shortening the lengths of the bond wires 204, 205, and 206 in order of the bond wires 206, 205, and 204, a Yagi-Uda Antenna may be configured in which the bond wire 206 acts as a reflector, the bond wire 205 acts as an antenna element (a radiating device), and the bond wire 204 acts as a director.

If an antenna illustrated in the upper part of FIG. 13 is referred to as an antenna A, and an antenna illustrated in the lower part of FIG. 13 is referred to as an antenna B, whether to use which one of the antennas A and B may be selected by a switching operation of a switch installed in the IC chip 2. The switch may have the same structure as the switch sw illustrated in FIG. 8.

By shortening the lengths of the bond wires 201, 202, and 203 in order of the bond wires 201, 202, and 203 in the antenna A, and the lengths of the bond wires 204, 205, and 206 in order of the bond wires 206, 205, and 204 in the antenna B, in the modified example according to the second embodiment of the present invention, radiation directivities of the antennas A and B become opposite to each other.

Figure 14:
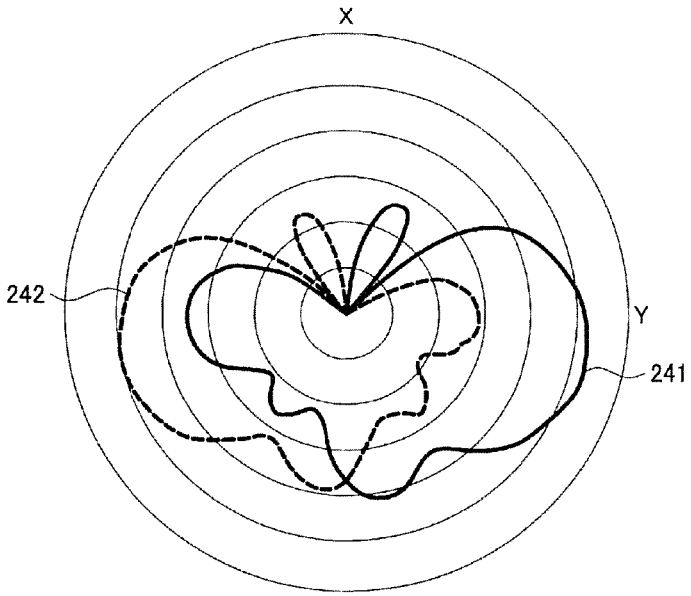
FIG. 14 illustrates an example of radiation directivities of antennas A and B in the modified example of the antenna apparatus according to the second embodiment of the present invention.

FIG. 14 illustrates an example of radiation directivity of the antennas A and B in the modified example of the antenna apparatus according to the second embodiment of the present invention. In FIG. 14, a line denoted by a reference numeral 241 shows radiation directivity of the antenna A, and a line denoted by a reference numeral 242 shows radiation directivity of the antenna B.

As such, in the antenna apparatus illustrated in FIG. 13, the antennas A and B have opposite radiation directivities. Accordingly, the modified example of the antenna apparatus according to the second embodiment of the present invention switches an antenna to another antenna using a switch, thereby changing radiation directivity so that communication can be performed according to a party for communication.

As described above, according to the embodiments of the present invention, an antenna composed of three elements may be formed on a printed board 1. According to the first embodiment of the present invention, an antenna apparatus capable of adjusting directivity by adjusting the length of each element of the antenna apparatus is provided.

Also, according to the embodiments of the present invention, an antenna apparatus capable of dynamically changing directivity by providing antennas each composed of three elements respectively in opposite edges of an IC chip and selecting an antenna to be used from among the antennas through switching is provided.

As described above, according to the embodiments of the present invention, the antenna apparatus may have directivity in a direction horizontal to a printed board by connecting a plurality of wires between the printed board and a chip, and using the wires as an antenna.

While the invention has been shown and described with reference to certain exemplary embodiments thereof, it will be understood by those skilled in the art that various changes in form and details may be made therein without departing from the spirit and scope of the invention as defined by the appended claims and their equivalents.

The invention claimed is:

1. An antenna apparatus comprising:

a dielectric substrate;

a semiconductor chip mounted on the dielectric substrate;

a first metal part, a second metal part, and third metal part each formed on the dielectric substrate;

a feeder formed on the semiconductor chip;

a fourth metal part formed on the semiconductor chip; and an antenna element configured to perform wireless communication in a frequency band of milliwaves, wherein the antenna element comprises a first wire connecting the first metal part to the fourth metal part, a second wire connecting the second metal part to the feeder, and a third wire connecting the third metal part to the fourth metal part, wherein the first wire, the second wire, and the third wire are each arranged in parallel to an edge of the semiconductor chip, and wherein the second wire is positioned between the first wire and the third wire.

2. The antenna apparatus of claim 1, wherein longer sides of the first and third metal parts are respectively aligned in a direction in which the first and third wires extend, and wherein the longer sides of the first and third metal parts are formed to be opposite to the semiconductor chip at ends at which the first and third wires are respectively connected to the first and third metal parts.

3. The antenna apparatus of claim 2, further comprising a first switch and a second switch that are provided in the first and third metal parts respectively and are configured to change lengths of the longer sides of the first and third metal parts respectively.

4. The antenna apparatus of claim 3, wherein a valid length of the first wire is a sum of a length of the first wire and a length of the longer side of the first metal part, wherein a valid length of the third wire is a sum of a length of the third wire and a length of the longer side of the third metal part, and wherein a wire having a longest valid length among the first wire, the second wire, and the third wire is used as a first element, a wire having a second longest valid length among the first wire, the second wire, and the third wire is used as a second element, and a wire having a shortest valid length among the first wire, the second wire, and the third wire is used as a third element.

5. The antenna apparatus of claim 4, further comprising a third switch configured to control on and off operations of the antenna element and an additional antenna element.

6. The antenna apparatus of claim 3, further comprising an additional antenna element, wherein the antenna element and the additional antenna element have opposite directivities.

7. The antenna apparatus of claim 2, wherein a valid length of the first wire is a sum of a length of the first wire and a length of the longer side of the first metal part, wherein a valid length of the third wire is a sum of a length of the third wire and a length of the longer side of the third metal part, and wherein a wire having a longest valid length among the first wire, the second wire, and the third wire is used as a first element, a wire having a second longest valid length among the first wire, the second wire, and the third wire is used as a second element, and a wire having a shortest valid length among the first wire, the second wire, and the third wire is used as a third element.

8. The antenna apparatus of claim 7, further comprising a third switch configured to control on and off operations of the antenna element and an additional antenna element.

9. The antenna apparatus of claim 2, further comprising an additional antenna element, wherein the antenna element and the additional antenna element have opposite directivities.

10. The antenna apparatus of claim 9, wherein the first element is configured to act as a reflector, the second element is configured to act as an antenna element, and the third element is configured to act as a director.

11. The antenna apparatus of claim 1, wherein the first wire, the second wire, and the third wire each has a length that is shorter than a next in order of the first wire, the second wire, and the third wire.

12. The antenna apparatus of claim 11, wherein a valid length of the first wire is a sum of a length of the first wire and a length of a longer side of the first metal part, wherein a valid length of the third wire is a sum of a length of the third wire and a length of the longer side of the third metal part, and wherein a wire having a longest valid length among the first wire, the second wire, and the third wire is used as a first element, a wire having a second longest valid length among the first wire, the second wire, and the third wire is used as a second element, and a wire having a shortest valid length among the first wire, the second wire, and the third wire is used as a third element.

13. The antenna apparatus of claim 12, further comprising a third switch configured to control on and off operations of the antenna element and an additional antenna element.

14. The antenna apparatus of claim 11, further comprising an additional antenna element, wherein the antenna element and the additional antenna element have opposite directivities.

15. The antenna apparatus of claim 1, wherein a valid length of the first wire is a sum of a length of the first wire and a length of a longer side of the first metal part, wherein a valid length of the third wire is a sum of a length of the third wire and a length of the longer side of the third metal part, and wherein a wire having a longest valid length among the first wire, the second wire, and the third wire is used as a first element, a wire having a second longest valid length among the first wire, the second wire, and the third wire is used as a second element, and a wire having a shortest valid length among the first wire, the second wire, and the third wire is used as a third element.

16. The antenna apparatus of claim 15, wherein the first element is configured to act as a reflector.

17. The antenna apparatus of claim 15, wherein the second element is configured to act as an antenna element.

18. The antenna apparatus of claim 15, wherein the third element is configured to act as a director.

19. The antenna apparatus of claim 1, further comprising an additional antenna element, wherein the antenna element and the additional antenna element have opposite directivities.

20. The antenna apparatus of claim 19, further comprising a third switch configured to control on and off operations of the antenna element and the additional antenna element.

* * * * *